United States Patent [19]

Hillis

[11] 4,428,639

[45] Jan. 31, 1984

[54] ELECTRICAL CONNECTOR

[75] Inventor: Frank M. Hillis, Franklin, N.Y.

[73] Assignee: The Bendix Corporation, Southfield, Mich.

[21] Appl. No.: 365,847

[22] Filed: Apr. 5, 1982

[51] Int. Cl.[3] ..... H01R 13/658

[52] U.S. Cl. ..... 339/143 R; 29/825; 29/854

[58] Field of Search ..... 339/143, 147; 29/825, 29/854, 882

[56] References Cited

U.S. PATENT DOCUMENTS

| | | | |
|---|---|---|---|
| 4,106,839 | 8/1978 | Cooper | 339/143 R |
| 4,330,166 | 5/1982 | Cooper et al. | 339/143 R |
| 4,349,241 | 9/1982 | Juris et al. | 339/143 R |

*Primary Examiner*—Joseph H. McGlynn

*Assistant Examiner*—David L. Pirlot

*Attorney, Agent, or Firm*—Charles D. Lacina

[57] ABSTRACT

An electrical connector including a pair of interfittable shells 11, 21, an annular shield ring 60 for protecting electrical contacts carried therein from RFI/EMI interference and means for mounting the shield ring to one of the shells, the one shell 21 having a radial flange 22 forwardly of an annular groove 50 sized to receive an annular band 62 of the shield 60. The mounting means are solderless and comprise an annular compression ring 40 sized to circumpose the annular groove 50 and be plastically deformed therein. The annular groove includes a frusto-conical wall 54 which serves to control plastic deformation of compression ring 40 so as to invade the groove 50 to press against shield band 62 and thereby secure the ring therein. Means 63 for resisting rotation of the shield ring are provided.

6 Claims, 11 Drawing Figures

FIG. 7
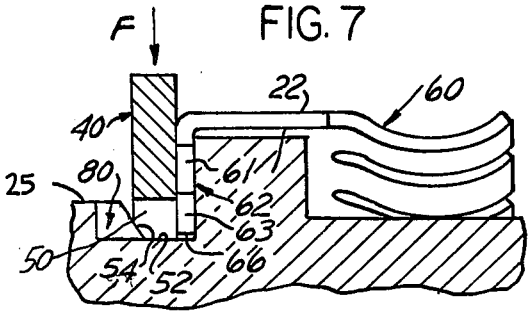
FIG. 9
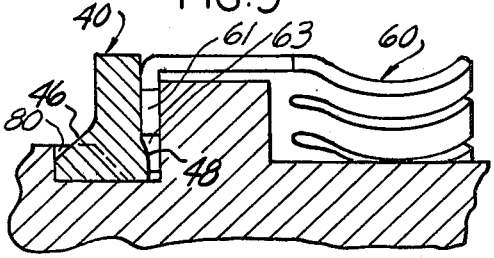
FIG. 8
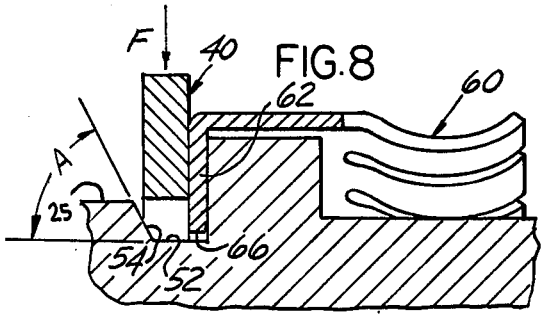
FIG. 10
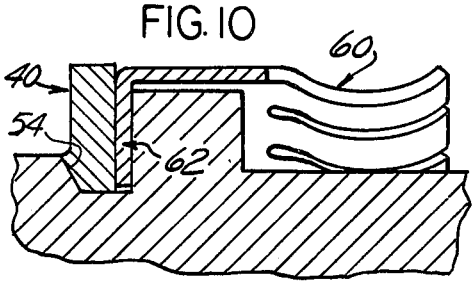
FIG. 6
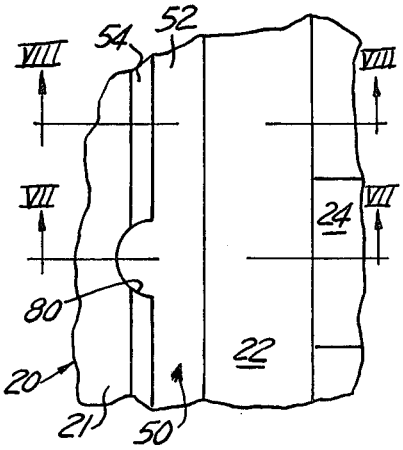
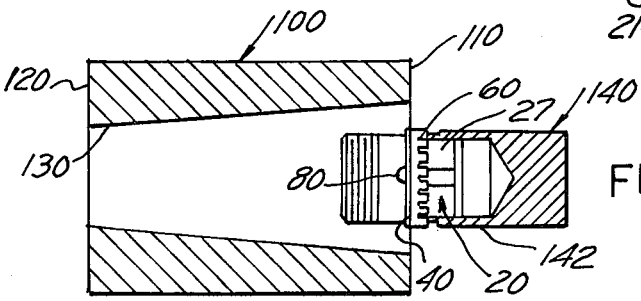
FIG. 11

ELECTRICAL CONNECTOR

This invention relates generally to an electrical connector having a shield ring for shielding electrical contacts from radio frequency interference and more particularly to a solderless arrangement for mounting the shield ring about a connector shell.

The use of shielding in electrical connector to eliminate unwanted radio frequency and electromagnetic signals (RFI/EMI) and electromagnetic pulses (EMP) from interfering with signals being carried by contacts in connectors is known. Previous U.S. Patents disclose annular shields comprised of sheet metal with spaced resilient fingers extending in one longitudinal direction to provide a spring connection between mating shell halves of the electrical connector. Further, some of these shields include a radial band which is received in an annular groove of one shell and the spring fingers of the shield are spaced circumferentially from each other to circumpose and contact the other shell and complete a ground path.

Presently the shield ring has to be soldered to a plated aluminum plug shell. Soldering the shield ring onto the connector shell is time consuming and requires numerous labor operations. A large amount of rework is required if the mounting is defective. Rework is required to repair blistered plating or broken soldered joints. Labor adds to overall product cost. However, a ring is ordinarily non-repairable if broken in the field is soldered to the connector shell. Further, the industry is tending to introduce plastic connector shells which would not lend themselves to being soldered.

Unless a shield ring were provided with means for resisting rotation in its groove, the solder would be subject to shearing forces which could break the soldered joint. Rotation of the shield ring could degrade frequency interference protection.

In the past, it has been found that some solderless approaches have resulted in a grounding ring mounting which is too sensitive to tolerance variations in order to be dependable. A loosely fitted ground ring will increase shell-to-shell resistance. Both shell-to-shell resistance and RFI/EMI protection are separate requirements which must be satisfied for qualifying a connector for acceptance under MIL-C38999H.

Accordingly, a compression ring according to this invention is utilized to assemble and retain a sheild ring on its respective connector shell.

Further and in accord with this invention, an assembly tool is disclosed which allows for rapid assembly of the compression ring and shield ring simultaneously to the connector shell.

Advantages of this invention are elimination of soldering as an expedient for coupling a shield ring to a connector shell, provision of an RFI/EMI shield which may be rapidly assembled (or repaired), less direct labor involved for assembly resulting in a cost reduction. Further, the assembled shielding ring is mounted much more strongly to its connector thereby resulting in greater field dependability and reduction in rework due to failure.

DETAILED DESCRIPTION OF THE INVENTION

FIG. 6 shows detail of an electrical plug shell having a locking feature for preventing rotation of the shield ring of FIG. 5.

FIGS. 7 and 8 are partial section views taken, respectively, along lines VII—VII and VIII—VIII of FIG. 6 showing the compression ring and the shield ring of FIG. 5 positioned about the connector shell of FIG. 6 for solderless assembly thereto.

FIGS. 9 and 10 show, respectively, FIGS. 7 and 8 with the rings in their completed assembly.

FIG. 11 shows a tool for compressing the compression ring about the plug shell.

Figure 1:
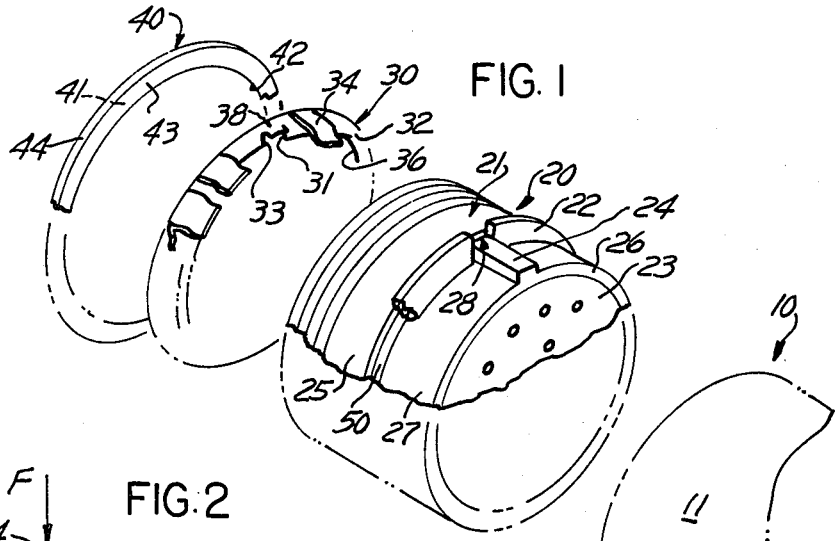
FIG. 1 is an exploded perspective view of a shield ring and a compression ring according to this invention about to be assembled to an electrical connector shell.

Turning now to the drawings, FIG. 1 shows an exploded fragmentary, longitudinal sectional view of plug and receptacle electrical connectors 10, 20 about to be mated. Each of the connectors are generally comprised of a cylindrical shell 11, 21 with a forward portion 27 of plug shell 21 being sized to telescopically interfit within a forward portion 17 of receptacle shell 11. The connectors have electrical contacts (not shown) therein which engage upon axial mating of the connector halves along a center axis thereof. Typically, a plurality of socket-type contacts are positioned in one connector for mating engagement with a like plurality of pin-type contacts in the other connector member, each of the contacts being positioned in insulators mounted within the respective shells. An insulator 23 is shown in plug shell 21 only. A radial flange 22 extends around the plug shell and a polarizing rib 24 extends axially forward from the flange to end face 26 of the plug shell, a portion of flange 22 including a radial slot 28 disposed in register with polarizing rib 24. Contiguous with and disposed rearwardly of flange 22 is an annular groove 50, the groove being continuous and extending around the rearward portion 25 of plug shell 21.

A coupling nut (not shown) is usually captivated for rotation on plug connector 20 for threadable engagement and coupling of plug connector 20 with receptacle connector 10. A keyway 14 (see FIG. 2) in the receptacle shell receives polarizing rib 24 to prevent relative rotation between the connector shells when the coupling nut rotates to draw the shells axially together along a central axis thereof.

An annular shielding ring 30 is adapted to be mounted in annular groove 50 adjacent to radial flange 22. Shield ring 30 is of a conductive material to ground the mated assembly and comprises a flat annular band 32 having a plurality of resilient, convexly-curved, fingers 34 extending from the outer circumference thereof and integrally formed therewith. Annular band 32 has a circumferential inner wall 36 (i.e., inner diameter) defining an opening sized to allow shield ring 30 to be slidably clearance fit over the outer diameter defining rearward end portion 25 of plug shell 21. Extending forwardly of band 32 is a tab 38 of a size adapted to fit slot 28 of flange 22, tab 38 serving as a means for preventing relative rotation therebetween. Tab 38 is struck upwardly from band 32 to form a pair of radial end faces 31, 33 in the band. Once fitted to the shell, the band is positioned so as to uniformly abut against the rearward face of flange 22.

Preferably and in accord with this invention, a generally flat compression ring 40 is provided for assembling the shield ring to the plug shell. Compression ring 40 is of generally uniform thickness and includes an outer circumferential face 44 defining a compression surface and an inner circumferential face 42 defining an opening passing through ring faces 41, 43 and sized to clearance fit over the rearward end portion 25 of plug shell 21. Compression ring 40 is positioned so that forward ring face 43 uniformly abuts against the back face of annular band 32 and inner circumferential face 42 (i.e., the opening) is circumposed around annular groove 50.

Compression ring 40 is made of an electrically conductive material such as copper or aluminum. Since the compression ring is included in the ground path of the shielded connector, the higher the electrical conductivity of the material used to form the compression ring the better. It is believed that there is less resistance through the ground path due to increased surface area contacted by band 32 with flange 22 and compression ring 40. That is, as shell-to-shell resistance decreases, shielding effectiveness increases. As such better frequency shielding is believed to result. A preferable material would be one which easily undergoes plastic deformation under compression. In one embodiment, a silver plated ring formed from AMS 4501 copper was found to satisfy and surpass the requirements of MIL-C38999H.

Figure 2:
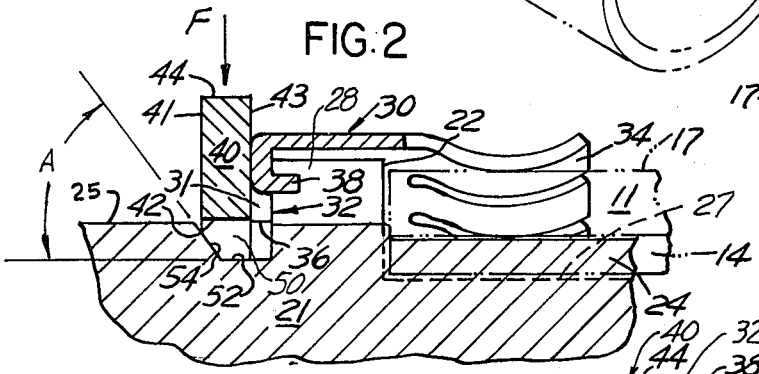
FIG. 2 is a partial section view of the rings shown in FIG. 1 positioned about the connector shell for solderless assembly thereto.

FIG. 2 shows in section a condition wherein shield ring 30 and compression ring 40 have been positioned about plug shell 21 so that annular band 32 abuts against radial flange 22, fingers 34 extend over and forwardly of radial flange 22, tab 38 is disposed in slot 28 and compression ring 40 has its forward ring face 43 disposed so as to abut against the rear face of annular band 32. As noted, tab 38 on shield ring 30 serves as an anti-rotation means for the shield ring relative to the connector shell. As shown, the convexly-curved fingers 34 of shield ring 30 extend forwardly of flange 22 and about forward portion 27 of the plug shell. Also and shown in phantom, the receptacle shell 10 is shown telescopically mated about the plug shell with polarizing rib 24 being fit within the receptacle keyway. The fingers 34, being sloted, are spring-like and resiliently flex during mating contact with outer surface 17 of the receptacle shell 10 to provide the desired frequency protection for the assembly.

Rearwardly of radial flange 22, annular groove 50 comprises an annular wall 52 and rearwardly extending chamfered wall 54. Chamfered wall 54 extends outwardly at a steep angle "A" from annular wall 52 to intersect shell wall 25, the chamfer being provided to define a frusto-conical or cam-like surface which will drive the compression ring 40 forwardly and thereby improve the seating of the compression ring when assembled to the connector. Chamfer angle "A" relates annular groove and annular wall (i.e. the undercut possible for a given shell thickness) with compression ring collapse. While a chamfer angle of approximately 60° is preferred, it is believed that a suitable range would be from 45°–70°. The chamfer is also beneficial since it compensates for parts that vary within dimensional tolerance ranges. The annular band 32 of shield ring 30 has an axial width or thickness which in combination with the thickness of compression ring 40 is less than the width of annular groove 50 disposed in the connector shell 21.

A radial compression force, designated at "F", would be applied against compression surface 44. This force would be in excess of the plastic limit of the compression ring material so as to cause cold-flow of the ring material.

Figure 3:
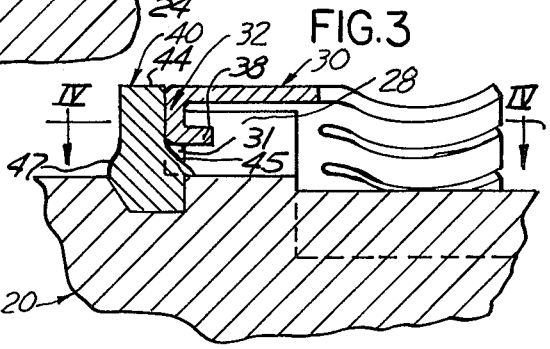
FIG. 3 is a partial section view of the completed assembly.

FIG. 3 shows a completed assembly wherein shield ring 30 and compression ring 40 have been assembled to the connector shell. The annular band of shield ring 30 is seated against the radial flange 22 and tab 38 positioned in the flange slot 28. The compression ring 40 is seated against the rear face of band 32. The compression ring has been plastically deformed radially inwardly into the annular groove. As can be seen, outer circumferential face 44 of compression ring 40 is compressed radially inwardly by force "F" to have substantially the same radial extension as that of shield ring 30. Part of compression ring 40, designated at 45, has been plastically deformed so as to flow between radial end faces 31, 33 of annular band 32 from which tab 38 has been struck. Another part of compression ring 40, designated at 47, has been plastically deformed so as to invade and be deformed against chamfered wall 54.

Figure 4:
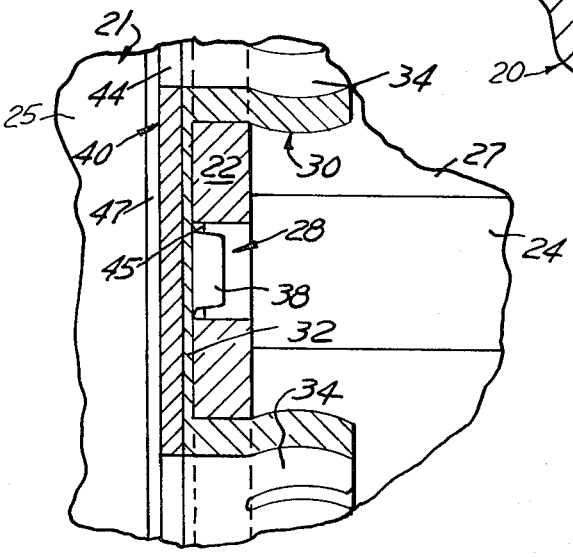
FIG. 4 is a partial section view taken along the lines IV—IV of FIG. 3 of the completed assembly.

FIG. 4 shows a top view of the completed assembly of FIG. 3. Here, compression ring 40 has been plastically deformed to lock tab 38 (i.e., the anti-rotation feature) within slot 28 of radial flange 22 and plastically deformed within annular groove 50 to force annular band 32 against radial flange 22.

FIGS. 5–10 show an alternate embodiment according to this invention wherein a shield ring 60 is non-rotatably mounted in annular groove 50 in the plug connector.

Figure 5:
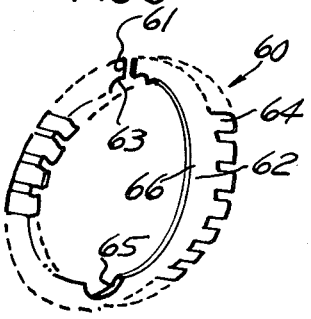
FIG. 5 is an alternate sheild ring according to this invention.

As shown in FIG. 5, shield ring 60 includes an annular band 62 having a plurality of resilient, convexly-curved, fingers 64 extending forwardly from its outer periphery. Annular band 62 has a circumferential inner wall 66 defining an opening size to clearance fit about annular wall 52 of annular groove 50, the band opening having an inside diameter less than the outside diameter of the shell rearward surface. Shield ring 60 has its band 62 radially slit at 61 so that the shield ring 60 may be deformed from its plane to fit over the shell outer surface and be received within the annular groove. Extending radially outwardly from the circumferential inner wall 66 (i.e., the opening of the band) are a pair of semi-circular cut-outs 63, 65 with each cut-out being disposed at approximately 180° one to the other and with semi-circular cut-out 63 being disposed in the slit at 61.

FIG. 6 shows a partial plan view of the plug shell 20 and shows annular groove 50 as comprising the continuous annular wall 52 and chamfered wall 54 having a continuous portion (as would be taken about line VIII—VIII) and a discontinuous portion (as would be seen taken about line VII—VII) comprising a rearwardly extending radial detent 80. Although not shown, preferably at least two radial detents 80 are provided with each radial detent being disposed approximately 180° from each other around the chamfered wall such that each radial detent 80 in chamfered wall 54 is in register with one of the semi-circular cut-outs 63, 65 of shield ring 60. In this embodiment, slot 28 would not be necessary.

FIGS. 7 and 8 show shield ring 60 being positioned so that band 62 is in abutment with radial flange 22, compression ring 40 circumposed above annular wall 52 and ready to be radially compressed by a radial force "F".

FIG. 7 shows a first section of shield ring 60, taken substantially along lines VII—VII of FIG. 6, wherein radial slit 61 and semi-circular cut-out 63 of annular band 62 are positioned so as to be in register with radial detent 80 disposed in chamfered wall 54.

FIG. 8 shows a second section of shield ring 60, taken substantially along lines VIII—VIII of FIG. 6, wherein the inward extension of band 62 is clearance fit about annular wall 52 defining the recess.

FIGS. 9 and 10, corresponding to FIGS. 7 and 8, respectively, show the result of a radial compression force "F" being applied radially inwardly to the compression ring 40. In both FIGS. 9 and 10, the outer diameter of compression ring 40 after plastic deformation is substantially equal to the outside diameter of shielding ring 60.

In FIG. 9, compression ring 40 is shown to have deformed and plastically flowed so that a first portion 46 flows into and invades each radial detent 80 and a second portion 48 flows into the semi-circular cut-outs 63, 65. It will be understood, of course, that semi-circular cut-outs 63, 65 are not necessarily in register with radially detents 80. It is believed, however, that a better securement comes when the semi-circular cut-outs are in register with the radial detents.

FIG. 10 shows that the compression ring has plastically deformed and flowed against chamfered wall 54 and band 62.

FIG. 11 shows a tool for applying a radially inwardly directed force "F" against outer surface 44 of compression ring 40. As shown, a die member 100 having a top face 110, a bottom face 120 and a conical bore 130 passing between the faces is adapted to receive plug shell 20 having the shield ring (either 30 or 60) and compression ring 40 positioned about annular groove 50, the conical bore having its largest diameter opening onto the top surface. A ram 140 having a cylindrical portion 142 is sized to clearance fit around and over the forward end 27 of the plug shell to abut radial flange 22 of the plug shell and thereby to force the assembly axially through the tapered bore 130 of die 100. As ram 140 moves the assembly through the bore, compression ring 40 engages the inner wall of the bore and is plastically deformed radially inwardly to such a point as it reaches the other end of the bore which represents the desired outward radial diameter of the compression ring. The connector 20, having its shield ring 60 and compression ring 40 assembled thereto, is ejected from the die by further axial movement of the ram through the bore.

While a preferred embodiment of this invention has been disclosed, it will be apparent to those skilled in the art, that changes may be made to the invention as set forth in the appended claims, and in some instances, certain features of the invention may be used to advantage without corresponding use of other features. Accordingly, it is intended that the illustrative and descriptive materials herein will be used to illustrate the principles of the invention and not to limit the scope thereof.

I claim:

1. An electrical connector comprising a pair of interfittable shells (11, 21), electrical contacts mounted within each shell which engage upon axial slidable mating of said shells along a center axis thereof, means (30, 60) circumposed around the outer surface of said electrical connector for frequency shielding said contacts and means (40) for mounting said shield means to one of said shells, said one shell (21) including a radial flange (22) and an annular groove (50) disposed in the outer surface (25) adjacent thereto, said shield means being of resilient metal and comprising an annular band (32, 62) having one face disposed in abutment against the flange and a portion (34, 64) convexly curved in the longitudinal direction, said mounting means being solderless and characterized by:

said annular groove (50) comprising an annular wall (52) and a chamfered wall (54) extending therearound with the chamfered wall defining a frusto-conical surface between the outer surface (25) and the annular wall (52); and an annular compression ring (40) comprised of a conductive material plastically deformed between the chamfered wall (54) and the other face of said annular band (32, 62) of said shield.

2. The electrical connector as recited in claim 1 further comprising means (28, 38; 80, 63) for preventing rotation of the shield ring (30, 60) relative to the flange.

3. The electrical connector as recited in claim 2 wherein said rotation preventing means comprises the chamfered wall (54) including a longitudinally extending radial detent (80) and said band (62) including an opening (66) sized to clearance fit about the annular wall, a radial slit (61) and a semi-circular cut-out portion (63), deformed portions of the compression ring (40) invading the radial detent (80) and the cut-out (63).

4. The electrical connector as recited in claim 2 wherein said rotation preventing means comprises the flange having a slot (28) and said band (32) including a tab (38) extending therefrom and into said slot, deformed portions of compression ring (40) flowing beneath the band and into the slot.

5. An electrical connector mating portion having a contacting element and an annular electrically conducting shell encircling said element and insulatively spaced therefrom, a continuous annular groove (50) disposed about said shell, a shielding ring (60) having a continuous band (62) coextensive with said groove and convexly curved spring fingers (64) extending forwardly therefrom, and means for mounting said shielding ring relative to said connector mating portion, said mounting means being solderless and characterized by:

an annular compression ring (40) having inner and outer circumferential faces (42, 44) and adapted to plastically deform when forced radially inward into said groove; and means (54) coextensive with said groove (50) for deforming the annular compression ring to form a compression fit.

6. The electrical connector as recited in claim 5 wherein said means for deforming the compression ring include a chamfered wall (54) extending frusto-conically inward from the shell outer surface (25) to an inner annular wall (52) defining the groove, the thickness of said band (62) and said compression ring (40) being less than the width of said annular groove (50).

* * * * *